US006273804B1

(12) United States Patent
Numoto

(10) Patent No.: US 6,273,804 B1
(45) Date of Patent: Aug. 14, 2001

(54) APPARATUS FOR POLISHING WAFERS

(75) Inventor: Minoru Numoto, Tokyo (JP)

(73) Assignee: Tokyo Seimitsu Co., Ltd., Tokyo (JP)

( * ) Notice: Subject to any disclaimer, the term of this patent is extended or adjusted under 35 U.S.C. 154(b) by 0 days.

(21) Appl. No.: 09/469,951

(22) Filed: Dec. 21, 1999

(30) Foreign Application Priority Data

May 10, 1999 (JP) ..... 11-128558

(51) Int. Cl.[7] ..... B24B 7/22
(52) U.S. Cl. ..... 451/288; 451/388; 451/398
(58) Field of Search ..... 451/288, 287, 451/289, 398, 388, 41

(56) References Cited

U.S. PATENT DOCUMENTS

| | | | | |
|---|---|---|---|---|
| 5,205,082 | | 4/1993 | Shendon et al. | 51/283 R |
| 5,423,716 | * | 6/1995 | Strasbaugh | 451/289 |
| 5,449,316 | * | 9/1995 | Strasbaugh | 451/289 |
| 5,527,209 | | 6/1996 | Volodarsky et al. | 451/388 |
| 5,584,751 | | 12/1996 | Kobayashi et al. | 451/288 |
| 5,643,061 | | 7/1997 | Jackson et al. | 451/289 |
| 5,851,140 | | 12/1998 | Barns et al. | 451/288 |
| 5,931,725 | * | 8/1999 | Inaba et al. | 451/288 |
| 6,033,292 | * | 3/2000 | Inaba | 451/287 |

FOREIGN PATENT DOCUMENTS

| | | |
|---|---|---|
| 0861706 A1 | 2/1998 | (EP) . |
| 0881039 A2 | 2/1998 | (EP) . |
| 6-79618 | 3/1994 | (JP) . |
| 8-229808 | 9/1996 | (JP) . |
| 10-012578 | 1/1998 | (JP) . |
| 10-270538 | 10/1998 | (JP) . |
| 10-92030 | 3/1999 | (JP) . |
| 11090820 | 11/1999 | (JP) . |
| WO 98/21008 A1 | 5/1998 | (WO) . |
| WO 99/33614 A1 | 7/1999 | (WO) . |

* cited by examiner

*Primary Examiner*—Robert A. Rose
(74) *Attorney, Agent, or Firm*—Christie, Parker & Hale, LLP

(57) ABSTRACT

An apparatus for polishing wafers wherein a retainer ring 40 is held by a carrier 32 of a wafer-holding head 20 by using an O-ring 31. Further, a protection sheet 80 for a wafer 2 is held by the retainer ring so as to cover the surface of an air-blow member 34 of the carrier. While the wafer is being held and polished, therefore, the back surface of the wafer does not come into direct contact with the carrier, and the protection sheet is interposed between the back surface of the wafer and the carrier.

17 Claims, 2 Drawing Sheets

APPARATUS FOR POLISHING WAFERS

BACKGROUND OF THE INVENTION

1. Field of the Invention

The present invention relates to an apparatus for polishing wafers and, particularly, to an apparatus for polishing semiconductor wafers relying upon a chemical-mechanical polishing (CMP) method.

2. Description of the Related Art

In recent years, ICs have been finely machined and IC patterns have been formed in a multiplicity of layers. Some degree of roughness is inevitably formed in the surfaces of the layers on which the patterns are formed. According to the prior art, the pattern of the next layer has been formed without any treatment. As the number of the layers increases and as the widths of the lines and holes decrease, however, it has become difficult to favorably form patterns and defects occur easily. Therefore, it has been attempted to form the pattern of the next layer after the surface of the layer on which the pattern is formed is flattened by polishing. The wafer-polishing apparatus (CMP apparatus) based on the CMP method is employed to polish the wafer in the step of forming the IC patterns.

There has been widely employed a wafer-polishing apparatus comprising a disk-like polishing table having a polishing pad stuck on the surface thereof, a plurality of wafer-holder heads that hold the surfaces on one side of the wafers to be polished and bring the other surfaces of the wafers into contact with the polishing pad, and a holder head drive mechanism for turning the wafer-holder heads relative to the polishing table, and wherein a slurry, which is a polishing agent, is supplied between the polishing pad and the wafers to polish the wafers.

As a wafer-holder mechanism in a wafer-holder head, there have heretofore been known one by which a wafer is adhered to a carrier via a wafer-adhering sheet (Japanese Unexamined Patent Publication (Kokai) No. 8-229808) and one by which a very finely porous insert having elasticity is adhered to the carrier and the wafer is held by being adhered thereto (Japanese Unexamined Patent Publication (Kokai) No. 6-79618).

According to the above-mentioned conventional wafer-holder mechanisms, however, a so-called packing sheet must be stuck to the surface of the carrier, and bubbles evolve at the time of sticking the packing sheet requiring skill for sticking, the degree of flatness on the surface on which the packing sheet is stuck affects the wafer-machining surface, and the wafer-holder head must be removed for sticking the packing sheet.

The applicant therefore has proposed an apparatus for polishing wafers in which an air-blowing member is provided under the lower surface of the carrier that is loosely supported in a wafer-holder head body so as to move up and down, in order to blow the air toward the back surface of the wafer thereby to form a pressurized fluid layer between the carrier and the wafer, and the wafer is held being pushed onto the polishing table via the pressurized fluid layer, as taught in Japanese Patent Application No. 10-92030 filed by the applicant.

Even in the wafer-holder mechanism in the above-mentioned apparatus for polishing wafers, however, the back surface of the wafer is likely to come into direct contact with the hard surface of the carrier and is scratched while the wafer is held by adsorption and is polished.

SUMMARY OF THE INVENTION

In view of the above-mentioned problem, the object of the present invention is to provide a wafer-holder mechanism which does not permit the back surface of the wafer to come into contact with the hard surface of a ceramic carrier and be scratched, and to facilitate the removal of the retainer ring so that the protection sheet can be easily attached.

As a means for solving the above-mentioned problem, the present invention provides an apparatus for polishing wafers as described in the claims.

In the apparatus for polishing wafers according to an embodiment of the present invention, a retainer ring is held by a carrier using an O-ring, enabling the retainer ring to be pulled down so as to be easily removed from the carrier and further enabling the retainer ring to be easily attached by simply pushing it. This facilitates the operation for exchanging the protection sheet and an exchange unit of the retainer ring within a short period of time, without permitting the slurry to dry that could cause scratching, and decreasing the time in which the retainer ring is immersed in water for preventing the slurry from drying.

When fitted to the carrier, further, the centering of the retainer ring is easily accomplished relying on the O-ring.

In the apparatus for polishing wafers according to another embodiment of the present invention, an air-blow member is provided on the lower surface of the carrier and a protection sheet is provided on the outer surface thereof, in order to prevent the back surface of the wafer from coming in contact with the surface of the hard carrier and being scratched.

In the apparatus for polishing wafers according to a further embodiment of the present invention, the peripheral edges of the protection sheet are held by the retainer ring, so that the protection sheet can be easily attached.

In the apparatus for polishing wafers according to a still further embodiment of the present invention, the retainer ring is constituted by three members, i.e., a retainer body, an exchange unit and a fall-stop fitting, in a manner that it can be assembled and disassembled, enabling the exchange unit to be quickly and easily exchanged, the exchange unit being subject to abrasion caused by being in contact with the polishing pad at all times and being likely to be exchanged relatively frequently. Further, the peripheral edges of the protection sheet can be held by the retainer body and by the exchange unit, and can be easily attached and detached.

In the apparatus for polishing wafers according to a yet further embodiment of the present invention, a ring-like groove is formed on the inside in the lower surface of the retainer body or on the inside in the upper surface of the exchange unit, to impart a margin for the elongation of the protection sheet. This permits the protection sheet to easily elongate.

In the apparatus for polishing wafers according to a further embodiment of the present invention, a ring-like thick portion is formed along the outer periphery of the protection sheet to prevent the protection sheet from escaping.

In the apparatus for polishing wafers according to another embodiment of the present invention, a disk-like recess is formed in the protection sheet, in order to absorb irregularity in the pushing force caused by the protection sheet having irregular thickness. Further, the air gap is maintained to a sufficient degree to maintain a favorable flow of air.

In the apparatus for polishing wafers according to a further embodiment of the present invention, the protection sheet is provided with holes for adsorption to reliably hold the wafer by adsorption.

Even when the air is blown out from the air-blow member of the carrier while the wafer is being polished, the protection sheet is pushed onto the back surface of the wafer, and the holes for adsorption are closed and no air is permitted to escape through the holes for adsorption.

The present invention may be more fully understood from the description of preferred embodiments of the invention set forth below, together with the accompanying drawings.

DESCRIPTION OF THE PREFERRED EMBODIMENTS

An apparatus for polishing wafers according to an embodiment of the present invention will now be described below with reference to the drawings.

Figure 1:
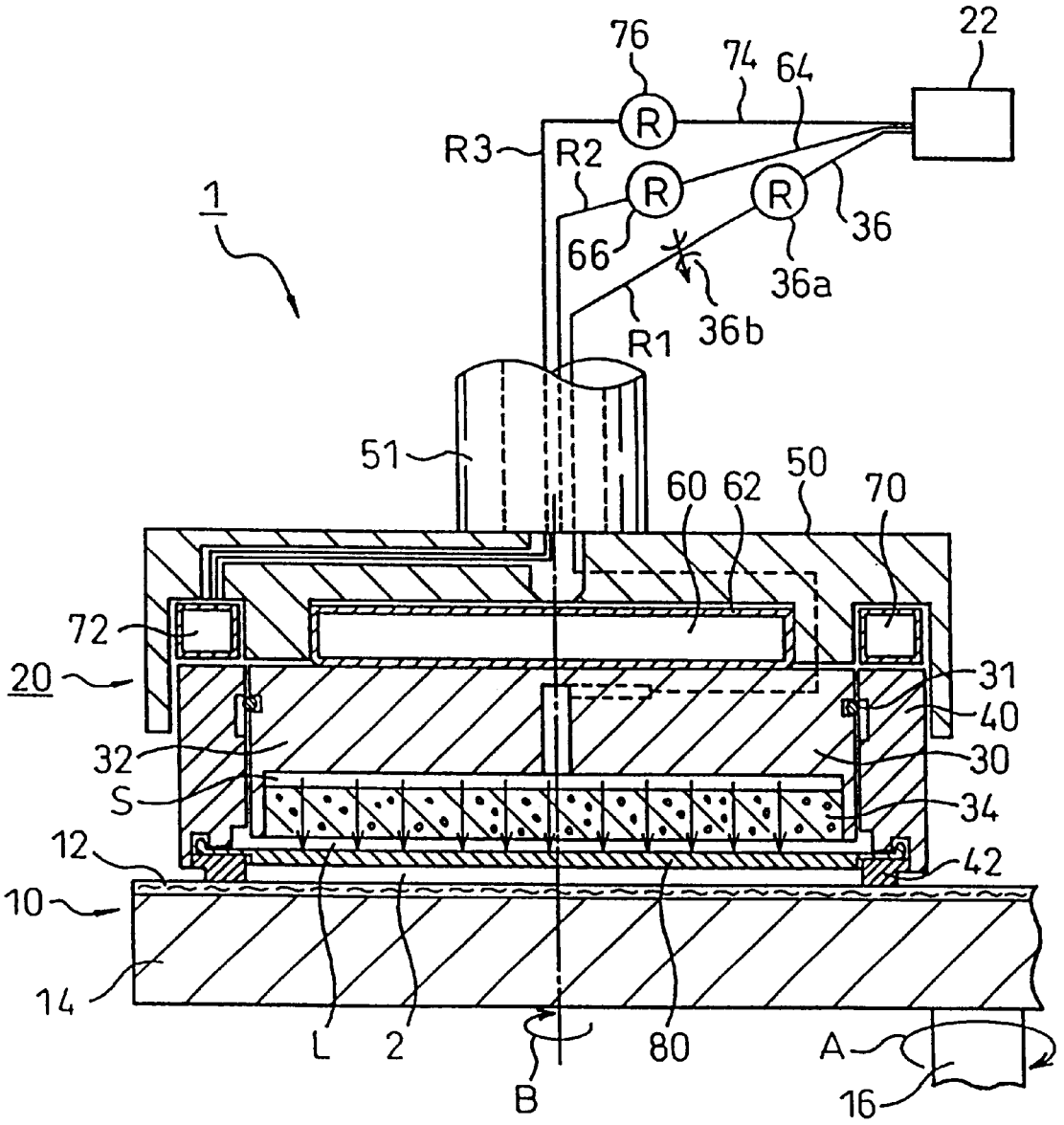
FIG. 1 is a sectional view of an apparatus for polishing wafers according to an embodiment of the present invention.

Referring to FIG. 1, the apparatus 1 for polishing wafers according to an embodiment of the present invention includes a table 10 for polishing a wafer 2, and a holder head 20 that holds the wafer 2 and turns the wafer 2 while pushing it onto the polishing table 10 with a desired polishing pressure.

The polishing table 10 includes a polishing pad 12 having a polishing surface of a circular shape as viewed on a plane for polishing the wafer 2, a rotary plate 14 having the polishing pad 12 stuck onto the upper surface thereof, and a rotary drive unit 16 that rotates the rotary plate 14 in a horizontal polishing direction (direction of arrow A) relative to the holder head 20.

The holder head 20 includes a fluid pushing unit 30 for forming a pressurized fluid layer L for pushing the wafer 2 onto the polishing pad 12, a retainer ring 40, formed in a cylindrical shape, surrounds the fluid pushing unit 30 and pushes the polishing surface of the polishing pad 12 around the periphery of the wafer 2, a head body 50 provided over the fluid pushing unit 30 and the retainer ring 40, a drive unit 51 for rotating the head body 50, an adjusting unit 60 provided between the head body 50 and the fluid pushing unit 30 and adjusts the polishing pressure imparted to the fluid pushing unit 30, and an adjusting unit 70, provided between the head body 50 and the retainer ring 40, imparts the pushing force to the retainer ring 40 to push the polishing pad 12 and adjusts the pushing force.

The fluid pushing unit 30 includes a carrier 32 having a recess 32*a* opened nearly over the whole area of the back surface 2*b* of the wafer 2, an air-blow member 34 having gas permeability separated from the back surface 2*b* of the wafer 2 and fitted to the lower end of the recess 32*a*, and an air-feeding mechanism 36 for feeding the air into space S between the ceiling surface 32*b* of the recess 32*a* and the air-blow member 34. A groove 33 into which an O-ring 31 will be fitted is formed in the outer peripheral surface of the carrier 32. The fluid pushing unit 30 is engaged with a stopper member that is not shown and will not to escape from the head body 50.

Figure 2:
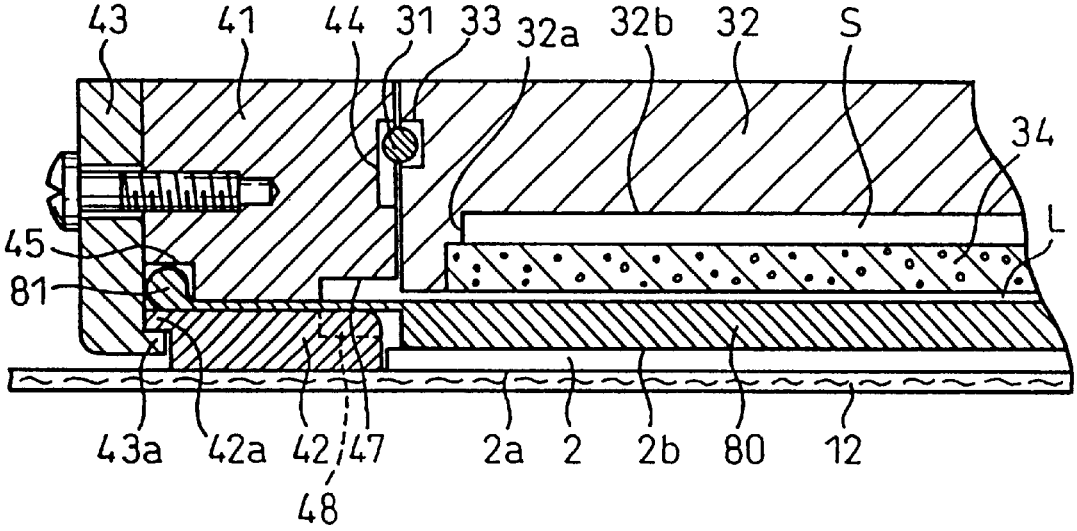
FIG. 2 is a sectional view illustrating, on an enlarged scale, a portion of the apparatus for polishing wafers, equipped with a protection sheet according to the embodiment of the present invention.

Referring to FIG. 2, the retainer ring 40 is constituted by a retainer body 41, an exchange unit 42, and a fall-stop fitting 43. The retainer body 41 and the exchange unit 42 holds the peripheral edges of the protection sheet 80 thereby to hold the protection sheet 80. The retainer body 41 is provided with a broad groove 44 formed in the inner peripheral surface thereof into which will fit the O-ring 31 enabling the retainer ring to move up and down, an annular groove 45 formed on the outer side in the lower surface thereof to accommodate a ring-like thick portion 81 formed along the outer peripheral portion of the protection sheet 80, an air-vent passage 46 formed in the radial direction, and a recess formed in the outer peripheral surface thereof into which will fit the fall-stop fitting 43. Depending upon the case, a ring-like groove 47 is formed in the inner periphery in the lower surface of the retainer body 41 to impart a margin for elongating the protection sheet 80. As required, the protection sheet 80 is provided with holes 82 for adsorption at plural places.

The exchange unit 42 is in the form of a ring and has a protuberance 42*a* formed on the outer peripheral surface thereof. In the exchange unit 42, too, a ring-like groove 48 is formed, as required, on the inner side in the upper surface thereof.

The fall-stop fitting 43 is fitted into the recess in the outer periphery of the retainer body 41 at, for example, three places, and is secured to the retainer body 41 by using bolts or the like. The fall-stop fitting 43 has, at its lower portion, an inwardly directed protrusion 43*a* that engages with the protuberance 42*a* of the exchange unit 42 to prevent the exchange unit 42 from falling.

Therefore, the retainer ring 40 can be easily removed from the carrier 32 by pulling it down, and can be easily attached to the carrier by pushing it.

The air-feeding mechanism 36 includes a pump 22, a regulator 36*a* provided on an air-feed passage R1 between the pump 22 and the recess 32*a* and adjusts the pressure of the air that is fed, and a throttle 36*b* for adjusting the flow rate of the air that is fed.

The air-blow member 34 contains many air-permeating passages and comprises, for example, a sintered product of a ceramic material.

The adjusting unit 60 is provided between the head body 50 and the fluid pushing unit 30, and includes an air bag (pushing means) 62 that expands and contracts as the air is introduced and exhausted to adjust the polishing pressure, and an air-feeding mechanism 64 for feeding the air to the air bag 62. The air-feeding mechanism 64 includes a common pump or separate pumps 22, and a regulator 66 provided on an air-feed passage R2 between the pump 22 and the air bag 62 to adjust the pressure of the air that is fed.

The adjusting unit 70 is provided between the head body 50 and the retainer ring 40, and is constituted by an air bag 72 that expands and contracts as the air is introduced and exhausted to adjust the polishing surface, and an air-feeding mechanism 74 for feeding the air to the air bag 72. The air-feeding mechanism 74 includes a common pump or separate pumps 22, and a regulator 76 provided on an air-feed passage R3 between the pump 22 and the air bag 72 to adjust the pressure of the air that is fed.

Described below is a method of polishing the wafer 2 by using the apparatus 1 for polishing wafers.

The head body 50 is pushed onto the wafer 2; i.e., the wafer 2 is held by the surface of the protection sheet 80 or by being adsorbed by the surface of the protection sheet 80 by vacuum that is created by being connected to the head body 50, and is carried onto the polishing table 10. Next, the air pressure in the air bag 62 is adjusted by the air-feeding mechanism 64 in the adjusting unit 60, in order to adjust the polishing pressure imparted to the fluid pushing unit 30. At the same time, the air having an adjusted pressure is fed in an adjusted flow rate from the air-feeding mechanism 36 into space S between the ceiling surface 32*b* of the recess 32*a* and the air-blow member 34. The air stays in space S so that the pressure is uniform and is mildly introduced, at a uniform flow rate, between the air-blow member 34 and the protection sheet 80 through the air-blow member 34, whereby a pressurized fluid layer L of the air is formed between the air-blow member 34 and the protection sheet 80 to transmit a polishing pressure uniformly over the whole area of the back surface 2*b* of the wafer 2. The air forming the pressurized fluid layer L flows out through the air-vent passage 46 in the retainer body 41 and other gaps in an amount equal to the amount by which it was introduced. Even when the air is blown out from the air-blow member 34, the protection sheet 80 readily comes into intimate contact with the back surface of the wafer 2, and the holes 82 for adsorption of the protection sheet 80 are readily closed.

Therefore, the back surface 2*b* of the wafer 2 is pushed by the pressurized fluid layer L via the protection sheet 80 over the whole area thereof irrespective of whether the wafer 2 is deformed or not. Despite there being swelling and dents in the polishing surface of the polishing table 10, therefore, the wafer 2 is pushed with a desired polishing pressure so as to comply with the swelling and dents, and is pushed onto the polishing surface with a uniform polishing pressure.

Further, the adjusting unit 70 adjusts the force with which the polishing pad 12 is pushed by the retainer ring 40. This prevents the polishing surface from swelling at the peripheral edges of the wafer 2.

The rotary drive unit 16 of the polishing table 10 is driven to rotate the polishing pad 12 in a horizontal polishing direction (direction of arrow A) together with the rotary plate 14, and the rotary drive unit 51 of the holder head 20 is driven so as to rotate in the direction of arrow B. Thus, the wafer 2 is polished.

Thus, the wafer 2 does not come into direct contact with the hard ceramic carrier 32 while it is being held and polished, but comes into contact with the protection sheet 80. Therefore, the back surface 2*b* of the wafer 2 is not scratched. The protection sheet 80 is made of a material having resistance against the acidic slurry or the alkaline slurry. For example, there can be preferably used a silicone rubber, polytetrafluoroethylene (Teflon, trademark) or the like.

Figure 3:
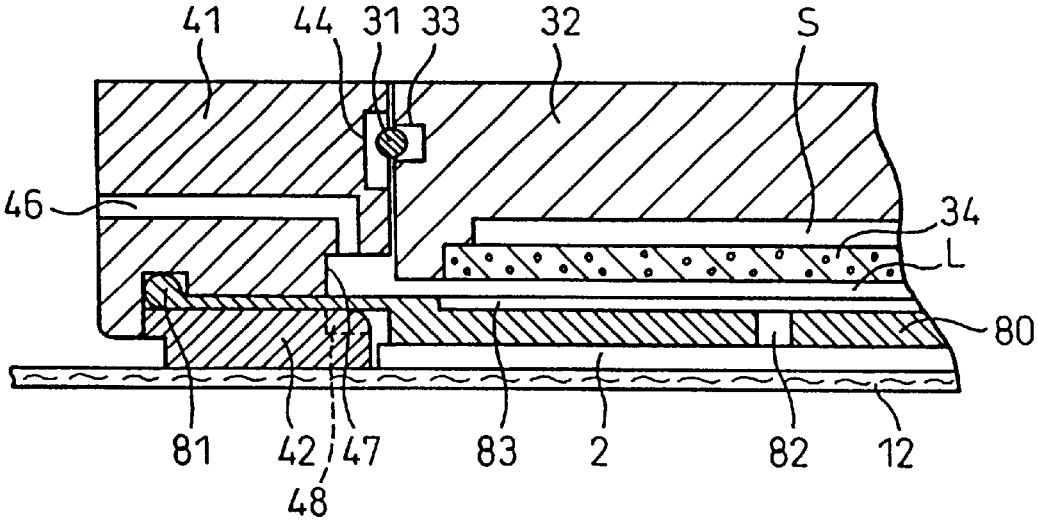
FIG. 3 is a sectional view illustrating, on an enlarged scale, a portion of the apparatus for polishing wafers, equipped with the protection sheet according to another embodiment of the present invention.

The protection sheet 80 may be provided with a disk-like recess 83 as shown in FIG. 3 to maintain the flow of the air to a sufficient degree and to eliminate irregularity in the pushing force caused by the protection sheet 80 having irregular thickness. The protection sheet 80 has the ring-like thick portion 81 formed along the outer periphery thereof and is prevented from escaping. The protection sheet 80 that is pushed onto the wafer 2 is able to hold the wafer 2 even without the holes 82 for adsorption.

The exchange unit 42 of the retainer ring 40 is maintained pushed to the polishing pad 12 during the operation for polishing the wafer 2, and is subject to be worn out. Therefore, the exchange unit 42 is made of a material such as vinyl chloride or polyetheretherketone, and is relatively frequently exchanged.

In the present invention, the retainer ring 40 and the carrier 32 are held by the O-ring 31 even during the operation for exchanging the exchange unit 42 of the retainer ring 40 and the protection sheet 80. Therefore, the retainer ring 40 can be easily removed from the carrier 32 by pulling it. Besides the retainer body 41 and the fall-stop fitting 43, which are fastened by bolts, can be easily removed, making it possible to easily exchange the exchange unit 42 and the protection sheet 80 within short periods of time.

While the invention has been described by reference to specific embodiments chosen for purposes of illustration, it should be apparent that numerous modifications could be made thereto by those skilled in the art without departing from the basic concept and scope of the invention.

What is claimed is:

1. An apparatus for polishing the surface of a wafer by holding the wafer by a holder head and pushing the wafer onto a polishing pad on a rotary polishing table, wherein:

said holder head includes a head body that rotates and is arranged opposed to said polishing table, a carrier loosely supported by said body so as to be able to move up and down, and a retainer ring that surrounds the periphery of said wafer and comes in contact with said polishing pad together with said wafer; and said retainer ring is held by said carrier using an O-ring;

wherein an air-blow member is provided on the lower surface of said carrier, a protection sheet is provided on the outer surface of said air-blow member, and said wafer is pushed onto said polishing pad by a layer of the air blown from said air-blow member via said protection sheet.

2. An apparatus for polishing wafers according to claim 1, wherein the peripheral edges of said protection sheet are held by said retainer ring.

3. An apparatus for polishing wafers according to claim 1, wherein said retainer ring is constituted by three members including a retainer body, an exchange unit and a fall-stop fitting, in a manner that it can be assembled and disassembled.

4. An apparatus for polishing wafers according to claim 2, wherein said retainer ring is constituted by three members including a retainer body, an exchange unit and a fall-stop fitting, in a manner that it can be assembled and disassembled.

5. An apparatus for polishing wafers according to claim 4, wherein a groove is formed either on the inside in the lower surface of said retainer body or on the inside in the upper surface of said exchange unit, or in both of them, in order to impart a margin for the elongation of said protection sheet.

6. An apparatus for polishing wafers according to claim 2, wherein a thick portion is formed along the outer periphery of said protection sheet to prevent it from escaping.

7. An apparatus for polishing wafers according to claim 2, wherein a recess is formed in said protection sheet.

8. An apparatus for polishing wafers according to claim 6, wherein a recess is formed in said protection sheet.

9. An apparatus for polishing wafers according to claim 2, wherein holes for adsorption are formed in said protection sheet.

10. An apparatus for polishing wafers according to claim 6, wherein holes for adsorption are formed in said protection sheet.

11. An apparatus for polishing wafers according to claim 7, wherein holes for adsorption are formed in said protection sheet.

12. An apparatus for polishing wafers according to claim 8, wherein holes for adsorption are formed in said protection sheet.

13. An apparatus for polishing the surface of a wafer by holding the wafer by a holder head and pushing the wafer onto a polishing pad on a rotary polishing table, wherein:

said holder head includes a head body that rotates and is arranged opposed to said polishing table, a carrier loosely supported by said body so as to be able to move up and down, and a retainer ring that surrounds the periphery of said wafer and comes in contact with said polishing pad together with said wafer;

said retainer ring is held by said carrier using an O-ring; and said retainer ring is constituted by three members including a retainer body, an exchange unit and a fall-stop fitting, in a manner that it can be assembled and disassembled.

14. An apparatus for polishing wafers according to claim 4, wherein a ring-shaped groove is formed either on the inside in the lower surface of said retainer body or on the inside in the upper surface of said exchange unit, or in both of them, in order to impart a margin for the elongation of said protection sheet.

15. An apparatus for polishing wafers according to claim 2, wherein a ring-shaped thick portion is formed along the outer periphery of said protection sheet to prevent it from escaping.

16. An apparatus for polishing wafers according to claim 2, wherein a cylindrical recess is formed in said protection sheet.

17. An apparatus for polishing wafers according to claim 6, wherein a cylindrical recess is formed in said protection sheet.

* * * * *